US007101198B2

(12) United States Patent
Listing et al.

(10) Patent No.: US 7,101,198 B2
(45) Date of Patent: Sep. 5, 2006

(54) PRINTED CIRCUIT BOARD PLUG-IN CONNECTION

(75) Inventors: Martin Listing, Langen (DE); Gerzson Toth, Mannheim (DE); Oliver Fuck, Taunusstein-Orlen (DE); Kurt Schaaf, Heidelberg (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/010,582

(22) Filed: Dec. 13, 2004

(65) Prior Publication Data

US 2005/0153579 A1 Jul. 14, 2005

(30) Foreign Application Priority Data

Dec. 17, 2003 (DE) ..... 103 59 232

(51) Int. Cl.
*H01R 12/00* (2006.01)

(52) U.S. Cl. ..... 439/76.1; 439/376; 439/341

(58) Field of Classification Search ..... 439/376, 439/76.1, 341
See application file for complete search history.

(56) References Cited

U.S. PATENT DOCUMENTS 4,972,296 A * 11/1990 Chu ..... 361/725
5,476,392 A 12/1995 Inaba et al.
6,083,027 A * 7/2000 Sato ..... 439/341
6,244,888 B1 * 6/2001 Cappe ..... 439/341
6,676,430 B1 * 1/2004 Conorich ..... 439/341

FOREIGN PATENT DOCUMENTS

EP 0 550 057 B1 4/1997
EP 1 544 957 A1 6/2005

OTHER PUBLICATIONS (XP-002314363) "Hinged multiple-contact electric connector- has housings of contact elements hinged relative to one another with rotation axis on contact axis"; (A.D. Andreev), Derwent Publications, Ltd., Oct. 7, 1981; 1 page.

* cited by examiner

*Primary Examiner*—Truc Nguyen
(74) *Attorney, Agent, or Firm*—Barley Snyder LLC

(57) ABSTRACT

A plug-in connection between a first connector at the edge of a printed circuit board and a second connector on a printed circuit board mount takes the form of a restrictedly guided swivel connection device. The printed circuit board with the first connector is swivelled about a swivel axis, which is held at the top, in the direction of the connector and at the bottom by an abutment. Escape by the connectors is prevented by engagement of the two outer walls of the connectors at a slide contact zone. Swivelling is only possible when the swivel axis has reached its desired position. Through swivelling of the arrangement, the blade contacts of the first connector make their way into the female contact elements of the second connector.

12 Claims, 3 Drawing Sheets

PRINTED CIRCUIT BOARD PLUG-IN CONNECTION

FIELD OF THE INVENTION

The invention relates to a plug-in connection for connecting a first connector, fitted to a printed circuit board and comprising first contact elements, to a second connector, located on a printed circuit board mount and comprising second contact elements.

BACKGROUND

Plug-in connections are known in various embodiments. One particular exemplary embodiment, to which reference will be made below without particular limitation, is a plug-in connection between a "punched grid" serving to accommodate electromechanical components and the like and electronics constructed on a printed circuit board. The electronics on the circuit board serve, inter alia, to drive electromechanical components arranged on the top of the punched grid. To this end, a first connector with, for example, blade contacts is located at one edge of the printed circuit board accommodating the electronics and a second connector with socket contacts matching the blade contacts is located in an edge area of the punched grid (i.e. the printed circuit board mount).

In the case of such plug-in connections, it is necessary for the first connector to be inserted into the second connector with a certain degree of force, such that the relevant blade contacts and socket contacts are connected mechanically and electrically.

There do exist "zero force" connectors, in which a connector receiving a printed circuit board equipped at the edges with contact elements is provided with two housing halves movable relative to one another. The two housing halves each carry a row of contact elements and may be moved away from one another counter to a spring-biasing force, in order to form a gap for the introduction of the side of the printed circuit board equipped with the contact elements. After introduction of the printed circuit board, the two halves of the connector are brought into a closed position, such that the contacts located at the edge of the printed circuit board lie against the contact elements in the connector. The purpose of such arrangements is to bring about a connection without having to apply a great deal of force.

A similar purpose is served by connector arrangements in which assembly of the connectors is facilitated by means of lever elements on one or the other of the connectors.

It is an object of the present invention to provide a plug-in connection in which the two connectors may be reliably connected with relatively little force.

SUMMARY

This object is achieved according to the invention by a restrictedly guided swivel connection device.

The term "swivel connection device" (or pivot connection device) herein means, in its most general form, that the connection process does not correspond to a rectilinear movement, but rather to a swivel or pivot movement. The term "restrictedly guided" herein means that, in a connection process taking the form of a swivel or pivot movement, the first connector moved relative to the second connector moves in a defined movement path, i.e. it cannot move off in an uncontrolled manner in one or the other direction. By means of the swivel movement, which presupposes the provision of a swivel or pivot bearing or a swivel axis, the first and second connectors are coupled together such that the frictional force to be overcome when the plug-in connection is brought about develops a negative component, which is absorbed by the swivel bearing or the restricted guidance system.

The restricted guidance system of the plug-in connection according to the invention ensures that the correct contact elements in the two connectors find one another. One particular development of the invention is characterised in that a swivel axis is provided on the printed circuit board, in that the first connector comprises a first outer wall located (radially) externally relative to the swivel axis, a first inner wall arranged internally relative to said first outer wall and a row of male (plug-in) contact elements or female (socket) contact elements, for example blade contacts, arranged between the first outer wall and the first inner wall, and in that the second connector comprises a second outer wall and a second inner wall with female contact elements or male contact elements, for example socket contacts, arranged therebetween and is surrounded in the connected state by the first outer and first inner walls of the first connector. In the connected state, therefore, the first connector sits on the second connector with the first inner wall and the first outer wall of the first connector surrounding the second inner wall and second outer wall of the second connector with the contact elements located therebetween. The inner walls and outer walls of both connectors are at a defined distance from the swivel axis and are so shaped according to the invention that not only, on the one hand, is it possible for the two connectors to swivel unhindered relative to one another, but also, on the other hand, parts of the inner walls and/or outer walls are in sliding contact with one another during the swivelling process, i.e. form a restricted guidance system or at least participate in forming a restricted guidance system.

In the case of the plug-in connection according to the invention, when the tips of the male contact elements, for example the blade contacts, first meet the end faces of the associated socket contacts, their longitudinal axes do not form a straight line therewith but rather form an acute angle with the longitudinal axes of the female (socket) contact elements, said angle reducing as the procedure continues until, when the two connected connectors have reached their final position, the longitudinal axes of the first and second contact elements coincide or extend parallel to one another in the two connectors.

If the overall arrangement is appropriately dimensioned, then the oblique meeting of the male contact elements and the female contact elements neither damages the contact elements nor noticeably hinders the connection process.

In one particular embodiment, the invention is characterised in that the printed circuit board and the first connector comprise side walls with bearing journals projecting outwards therefrom and defining the swivel axis, and in that on the top of the printed circuit board mount there is fitted approximately perpendicularly a receiving housing with two side walls, between which the second connector extends parallel to the swivel axis and in which there are formed insertion slots for the bearing journals. The insertion slots are oriented in particular approximately along the bisector between the top of the printed circuit board mount and the receiving housing.

With such an arrangement, the printed circuit board with the first connector arranged thereon is so positioned for the connection process relative to the printed circuit board mount that the bearing journals are located in the vicinity of the insertion slots. The printed circuit board is then displaced in its plane, while the bearing journals are guided by the insertion slots until the bearing journals reach the ends of the insertion slots. In this position, the printed circuit board forms with the printed circuit board mount an angle of approximately 45° (angles of between for example 20° and 70° are also possible), and, moreover, the printed circuit board forms an equally large angle of 45° (or 90° less the angle between printed circuit board and printed circuit board mount) in relation to the receiving housing. From this position, the printed circuit board may then be swivelled in restrictedly guided manner about the swivel axis, until it is received by the receiving housing, wherein, in this final position, the two connectors are connected together.

As mentioned above, the walls of the first and second connectors may serve in providing the restricted guidance for the swivel plug-in connection. It is particularly favourable for the ends of the insertion slots to be bent, in order to form an upper limit stop. The term "upper" relates here implicitly to a substantially horizontal orientation of the printed circuit board mount, a substantially vertical orientation of the receiving housing fitted to the printed circuit board mount and an oblique translational insertion movement for introducing the printed circuit board with the bearing journals into the insertion slots in the receiving housing. The term "up" and the terms associated therewith do not therefore imply any limitation, for instance from the point of view of indicating an installation position of the entire arrangement in a motor vehicle for example.

The "upper" limit stop forms an abutment, against which the bearing journals rest during swivelling, such that the printed circuit board with the first connector located thereon cannot move upwards when the plug-in connection is brought about. Provision is made in particular for the insertion slots to define an orientation in which the printed circuit board is introduced approximately parallel to the plane thereof with the bearing journals and the end area of the insertion slots defines a preliminary catch position, from which the printed circuit board may only either be withdrawn again or swivelled into the final connected position. The printed circuit board is initially inserted in translational manner, wherein the bearing journals are guided by the insertion slots in the receiving housing. The last portion of the insertion slots is bent relative to the rest of the insertion slots. The printed circuit board and the first connector located thereon are then in a position, relative to the printed circuit board mount or the second connector, in which the inner walls and outer walls of the two connectors would collide with one another if an attempt were made to swivel the printed circuit board. To allow swivelling, the bearing journals and with them the printed circuit board and the first connector have to be displaced until the bearing journals have fully reached the ends of the bent insertion slots. From this position, the printed circuit board may be swivelled to bring about the plug-in connection. During this swivelling process, the tops of the end areas of the insertion slots each form a limit stop, which functions as an abutment for forces arising during the making of the plug-in connection.

The above-mentioned restricted guidance system may be defined by the configuration of the insertion slots, a sliding contact area on the inside of the first outer wall of the first connector interacting with an outer edge of the second outer wall of the second connector, or a combination thereof. During the swivelling process, the inside of the first outer wall of the first connector slides over the outer edge of the second outer wall of the second connector. This prevents the printed circuit board from moving translationally despite the forces acting on the first connector and the printed circuit board, i.e. the swivel axis remains in its position, which is defined by the position of the bearing journals and the position of the end areas of the insertion slots in the receiving housing.

In order not to hinder the swivelling process, the upper edge of the second inner wall of the second connector is shorter than the upper edge of the second outer wall of the second connector. This shorter second inner wall of the second connector allows the first contact elements in the first connector to pass the second inner wall prior to the first contact elements of the first connector meeting with the second contact elements of the second connector.

In order to prevent the free edge of the first inner wall of the first connector from colliding with the second inner wall of the second connector, the first inner wall of the first connector is shorter than the first outer wall.

One particular embodiment is characterised in that the contact elements of the second connector take the form of female (socket) contact elements, and in that second outer and second inner walls of the second connector form, with their free ends, a mating contact element insertion opening, which is narrower than the contact element-receiving chamber downstream thereof and projects over the end-face ends of the female contact elements. In this configuration, the end-face ends of the female contact elements are protected from undesired collision with the male contact elements (blade contacts) of the first connector. The tips of the blade contacts are thus reliably guided into the insertion opening in the female contact elements.

BRIEF DESCRIPTION OF THE DRAWINGS

Exemplary embodiments of the invention are explained in more detail below with reference to the drawings, in which.

DETAILED DESCRIPTION OF THE EMBODIMENT(S)

Figure 1:
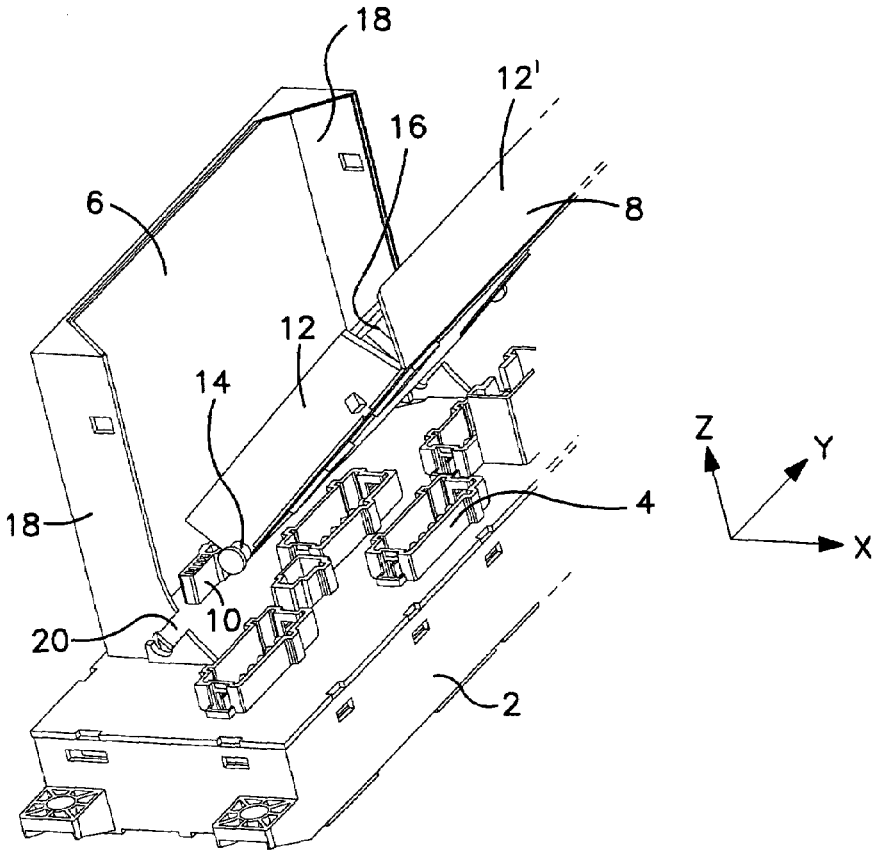
FIG. 1 is a perspective partial view of a punched grid to be equipped with an electronic printed circuit board.

The arrangement illustrated in FIG. 1 is an electrical/electronic device with a "punched grid" 2, which here functions as a printed circuit board mount, a receiving housing 6 positioned perpendicularly at the edge of the top of the punched grid 2 and an electronic printed circuit board 8, which is equipped with electronic components 16 and is designed for mechanical and electrical connection with the punched grid 2. On the top of the punched grid 2 there are located electromechanical components 4, for example relays etc. The overall arrangement is designed to be accommodated for example in a motor vehicle, as a constituent of the vehicle electrical system. Concealed by the top of the punched grid, the electromechanical components 4 inside the punched grid 2 are connected to one another and to contact elements of a female (socket) connector 10 at the edge of the punched grid 2. The electronic components 16 of the electronic printed circuit board 8 serve inter alia to drive the electromechanical components 4, but do have other tasks. In order to connect the electronic printed circuit board 8 (hereinafter simply printed circuit board) mechanically and electrically to the punched grid 2, a first connector, concealed in FIG. 1 and designed for coupling to the (second) connector 10 of the punched grid 2, is located on the lower end face of the printed circuit board 8.

To simplify the description of the arrangement shown in FIG. 1, a system of coordinates with the axes x, y and z is shown. The z-direction here denotes "up", without the arrangement being limited to any particular installation position. The plane of the punched grid 2 corresponds to the xy-plane and is also designated "horizontal". Accordingly, the receiving housing 6 is oriented in the z-direction, i.e. vertically.

Figure 2:
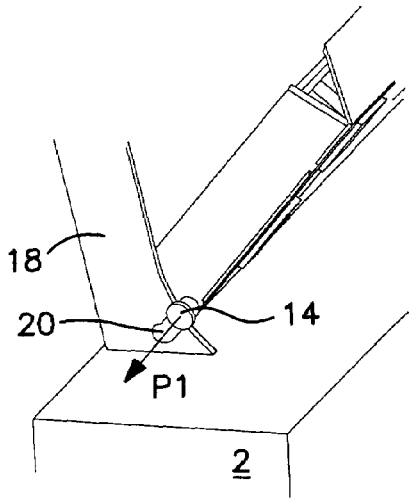
FIGS. 2 and 3 show a simplified representation of part of FIG. 1, wherein the printed circuit board to be introduced is illustrated in different stages of introduction into a preliminary catch position.
Figure 3:
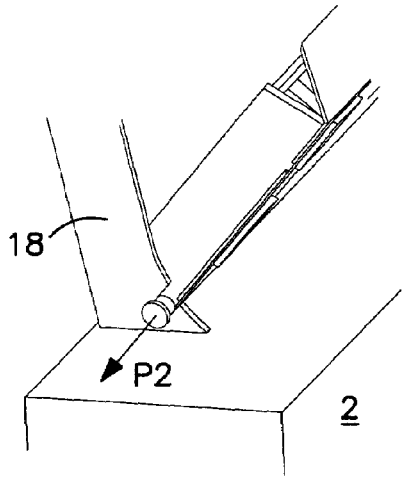

In order to connect the printed circuit board 8 to the punched grid 2, the printed circuit board 8 has side walls 12 and 12'. Bearing journals are fitted to the bottom corners of the illustrated side wall 12 and of the non-illustrated further side wall 12, which bearing journals define a swivel axis 14. As is clear from FIGS. 1, 2 and 3, the printed circuit board 8 is brought up to the receiving housing 6 in such a way that the printed circuit board 8 approximately forms a bisector between the punched grid 2 and the receiving housing 6, i.e. an angle of approximately 45° between the x-axis and the z-axis. The bearing journals are then positioned at the mouths of two insertion slots 20 (in FIG. 1 only one insertion slot 20 is visible). The printed circuit board 8 is then moved translationally in the direction of arrows P1 (FIG. 2) and P2 (FIG. 3).

Figure 4:
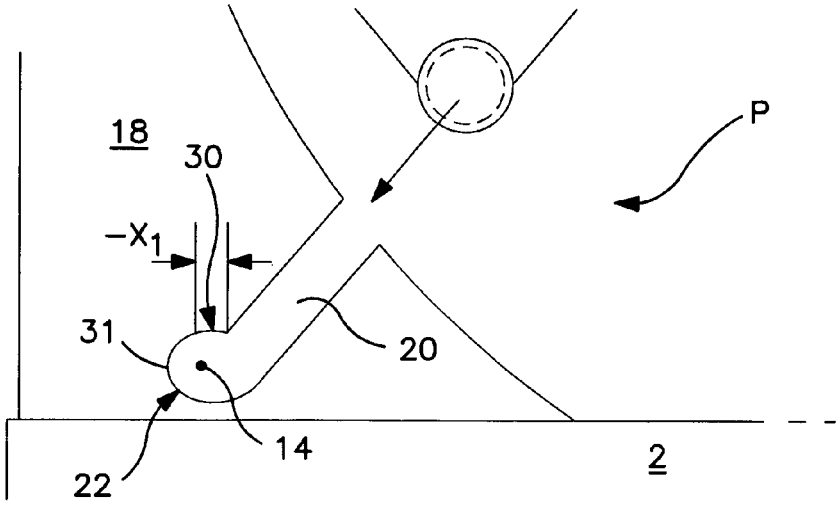
FIG. 4 is a simplified lateral view of a receiving housing shown on the punch grid of FIG. 1, which illustrates the structure of insertion slots in the receiving housing.

FIG. 4 shows the area of the insertion slot 20 in a side wall 18 of the receiving housing 6. The insertion slot 20 has a relatively long, straight portion, adjoined by a bent portion approximately parallel to the top of the punched grid 2. The end of the insertion slot 20 forms a lateral stop face 31 for a bearing journal to be described in more detail below, which bearing journal is centred on the swivel axis 14. The lateral stop face 31, the lower area of the end of the insertion slot 20 and the upper area, forming an upper limit stop 30, of the end of the insertion slot form a bearing journal seat 22. After oblique insertion of the bearing journals into the insertion slots 20 in the two side walls 18 of the receiving housing 6, the bearing journals are still not fully positioned in their respective bearing journal seats 22. Only after further displacement by the amount "$-x_1$ (FIG. 4) does the swivel axis 14 reach a position from which swivelling of the printed circuit board 8 is possible. The position which the printed circuit board 8 assumes with the swivel axis 14 at the point according to FIG. 4 is designated the preliminary catch position.

Figure 5:
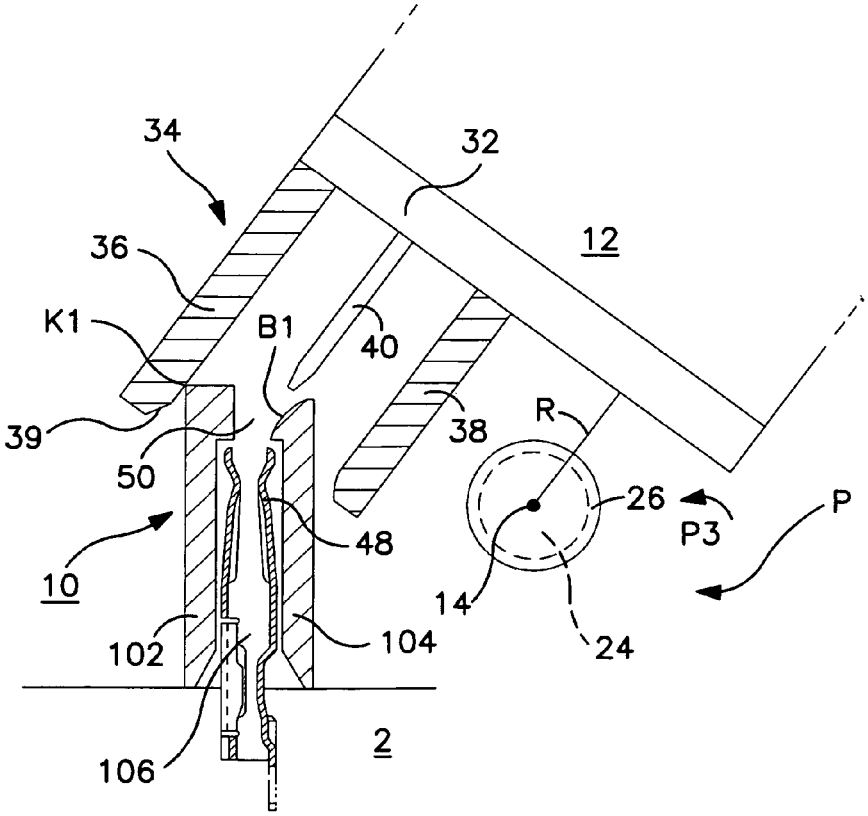
FIG. 5 is a partial sectional view of a restrictedly guided swivel connection device according to an exemplary embodiment of the invention, wherein the section plane extends at right angles to a swivel axis of the swivel connection device.

FIG. 5 shows a partial sectional view at right angles to the swivel axis 14. The connector 10 here designated second connector is visible at the edge of the top of the punched grid 2 (the receiving housing 6 is not indicated in FIG. 5).

The second connector 10 has a second outer wall 102 located externally relative to the swivel axis 14, and a second inner wall 104, which forms with the second outer wall 102, a contact element-receiving chamber 48 in which a female (socket) contact element 106 is accommodated. The upper, inner ends of the second outer wall 102 and the second inner wall 104 project inwardly and thus protrude over the ends of the female contact element 106 in order to provide protection relative to the male blade contact element 40 to be inserted. The first connector 34 matching the second connector 10 is located on the lower end face of the printed circuit board 8, of which only the bottom end of the one side wall 12 is visible here. The first connector 34 has a first outer wall 36 located externally relative to the swivel axis 14, a first inner wall 38 and the above-mentioned blade contacts constituting the male contact elements 40. The inner end of the first outer wall 36 facing the swivel axis 14 is provided with a bevel 39.

Figure 7:
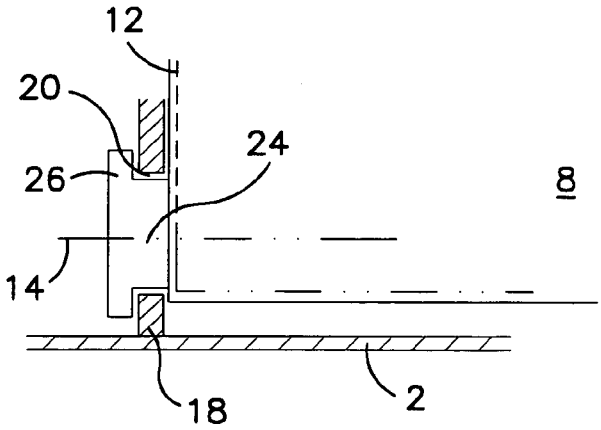
FIG. 7 is a partial sectional view of the coupling between a bearing journal connected to an electronic printed circuit board and an insertion slot formed in a receiving housing according to an exemplary embodiment of the invention.

FIG. 5 shows the situation after insertion of the printed circuit board 8 into the entry slots 20 and displacement of the printed circuit board into the preliminary catch position in accordance with the bent arrow P. The printed circuit board is guided in the insertion slots 20 during this process by the above-mentioned bearing journals. FIG. 7 shows a partial sectional view of a bottom corner of the printed circuit board 8 with the side wall 12 fixed thereto, to whose outer bottom end there is fixed a bearing journal 24, whose end is terminated by a projecting flange 26. Together with a bearing journal located symmetrically at the other bottom end of the printed circuit board 8, the bearing journal 24 with its flange 26, illustrated in FIG. 7, defines the swivel axis 14. The distance between the flange 26 and the outer side of the side wall 12 is only slightly larger than the thickness of the side wall 18 of the receiving housing 6, and the diameter of the bearing journal 24 is only slightly smaller than the width of the insertion slot 22, such that the printed circuit board 8 is guided with only minimal play when it is moved into the preliminary catch position.

In FIG. 5, the tip of the bent arrow P corresponds to the preliminary catch position. At the bend in the arrow, i.e. before the preliminary catch position is reached, the bottom edge in the area of the oblique face 39 of the first outer wall 36 meets the upper edge of the second outer wall 102 of the second connector 10. This prevents swivelling of the printed circuit board 8 before the preliminary catch position is reached. When the preliminary catch position according to the illustration in FIG. 5 has been reached, however, there is nothing to prevent the printed circuit board from swivelling. During the swivelling process according to arrow direction P3, the left-hand upper edge of the second outer wall 102 of the second connector 10 touches the inner face of the first outer wall 36 in a slide guide area K1. It is clear that in this situation a translational movement to the right in FIG. 5 (direction of the x-axis in FIG. 1) is prevented by the contact at the slide contact point K1 of the second outer wall 102 of the second connector 10 and the first outer wall 36 of the first connector 34. Upward movement of the arrangement is prevented by the upper area of the bearing journal 24 resting against the upper limit stop 30 of the last portion of the insertion slot (FIG. 4).

FIG. 5 shows that swivelling of the printed circuit board with the first connector 34 results in the tip of the blade contact 40 entering the insertion opening 50 and then the female (socket) contact element 106.

Figure 6:
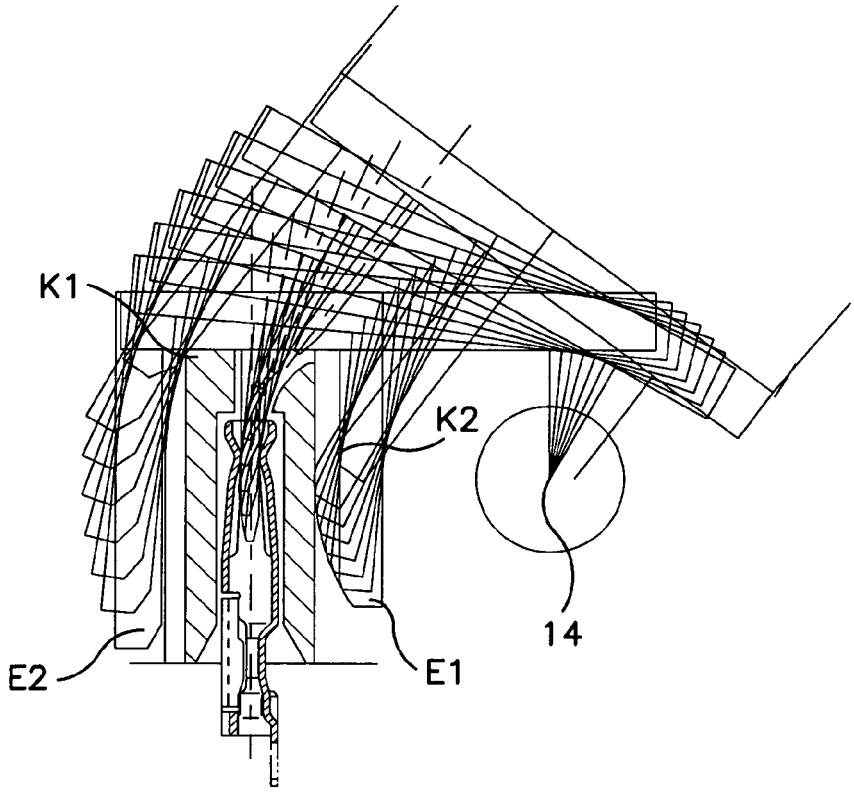
FIG. 6 shows different stages of a swivel connection process according to an exemplary embodiment of the invention.

FIG. 6 shows the individual stages of the swivel connection process. FIG. 6 shows that, during the majority of the swivel movement, the two outer walls 102, 36 of the connectors 10 and 34 touch at the slide guide area K1. During the swivel movement, the rounded surface zone b1 (FIG. 5) of the second inner wall 104 of the second connector 10, which second inner wall 104 is shorter than the second outer wall 102, makes it possible for the blade contact 40 to move past it reliably without collision.

According to FIG. 6, a bevel K2 on the inside of the first inner wall 38 of the first connector 34 prevents collision with the outer side of the second inner wall 104 of the second connector 10. The free end E1 of the first inner wall 38 of the first connector 34 is shorter than the end E2 of the first outer wall of this connector.

Figure 8:
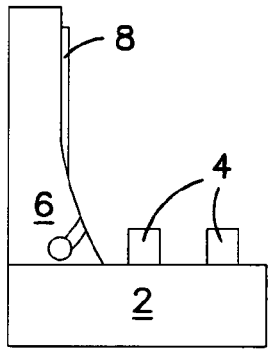
FIG. 8 shows the arrangement illustrated in FIG. 1 in a state having a fully plugged-in printed circuit board.

FIG. 8 shows the final situation after swivelling of the printed circuit board 8, which is then completely accommodated by the receiving housing 6.

The above-described embodiment may be modified in many different ways. For example, the insertion slots 25 do not have to take the form of through-slots in the side walls 18 of the receiving housing 6; instead, channels on the inside of the side walls 18 are also possible. The receiving housing 6 also does not need to be tall enough to accommodate the printed circuit board 8 completely. Male contact elements and female contact elements of the above embodiment may also occupy the opposite positions, i.e. the blade contacts 40 may be provided in the connector on the punched grid 2, while female contact elements are located in the other connector.

The person skilled in the art of connectors will recognise numerous possibilities for modifications, without going beyond the scope of the invention as outlined above and defined in the claims.

What is claimed is:

1. A plug-in connection for connecting a first connector to a second connector, comprising:

the first connector including a first outer wall and a first inner wall, first contact elements being arranged between the first outer wall and the first inner wall, the first connector being fitted to an end face of a printed circuit board, the printed circuit board having a swivel axis, the first inner wall being arranged closer to the swivel axis than the first outer wall;

the second connector including a second outer wall and a second inner wall, second contact elements being arranged between the second outer wall and the second inner wall, the second connector located on a printed circuit board mount; and the first and second connectors being connected by a restrictedly guided swivel connection device, the second outer and inner walls being surrounded by the first outer and the inner walls when the first and second connectors are connected.

2. The plug-in connection according to claim 1, wherein an upper edge of the second inner wall of the second connector is shorter than an upper edge of the second outer wall of the second connector.

3. The plug-in connection according to claim 1, wherein the first inner wall of the first connector is shorter than the first outer wall thereof.

4. The plug-in connection according to claim 1, wherein the second contact elements are female contact elements; and wherein the second outer and inner walls of the second connector form with their free ends a mating contact element insertion opening, which is narrower than a contact element-receiving chamber located downstream thereof and projects over end-face ends of the female contact elements.

5. The plug-in connection according to claim 1, wherein bearing journals project outwardly from side walls of the printed circuit board to define the swivel axis.

6. The plug-in connection according to claim 1, wherein bearing journals project outwardly from side walls of the printed circuit board to define the swivel axis; wherein a receiving housing with two side walls is fitted on a top of the printed circuit board mount approximately perpendicularly thereto; wherein insertion slots are formed in the two side walls of the receiving housing for receiving the bearing journals; and wherein the second connector extends between the two side walls of the receiving housing parallel to the swivel axis.

7. The plug-in connection according to claim 6, wherein that the insertion slots are oriented approximately along a bisector between the top of the printed circuit board mount and the receiving housing.

8. The plug-in connection according to claim 7, wherein ends of the insertion slots are bent, in order to form an upper limit stop.

9. The plug-in connection according to claim 6, wherein the insertion slots define an orientation in which the printed circuit board is introduced approximately parallel to a plane thereof with the bearing journals; and wherein the insertion slots have an end area thereof that defines a preliminary catch position from which the printed circuit board may only either be withdrawn again or swiveled into a final connected position.

10. The plug-in connection according to claim 6, wherein an inside surface of the first outer wall of the first connector forms a slide guide area with an outer edge of the second outer wall of the second connector.

11. The plug-in connection according to claim 6, wherein the insertion slots include a straight portion adjoined by a bent portion, the bent portion extending approximately parallel to the top of the printed circuit board mount.

12. The plug-in connection according to claim 5, wherein a receiving housing with two side walls is fitted on a top of the printed circuit board mount approximately perpendicularly thereto; and wherein insertion slots are formed in the two side walls of the receiving housing for receiving the bearing journals, the insertion slots include a straight portion adjoined by a bent portion, the bent portion extending approximately parallel to the top of the printed circuit board mount.

* * * * *